US006932001B2

(12) United States Patent
Wilfer

(10) Patent No.: US 6,932,001 B2
(45) Date of Patent: Aug. 23, 2005

(54) REFUSE BURNING CONTAINER

(76) Inventor: Ronald R. Wilfer, 2439 Mayfield Rd., Richfield, WI (US) 53076

( * ) Notice: Subject to any disclaimer, the term of this patent is extended or adjusted under 35 U.S.C. 154(b) by 0 days.

(21) Appl. No.: 10/264,275

(22) Filed: Oct. 3, 2002

(65) Prior Publication Data

US 2003/0140827 A1 Jul. 31, 2003

Related U.S. Application Data

(60) Provisional application No. 60/326,803, filed on Oct. 3, 2001.

(51) Int. Cl.[7] ..... F23G 5/00; F24C 1/16

(52) U.S. Cl. ..... 110/241; 110/251; 126/224; 126/25 B; 126/9 R

(58) Field of Search ..... 110/241, 251, 110/308, 314, 336; 126/222, 223, 224, 225, 25 B, 9 R, 77

(56) References Cited

U.S. PATENT DOCUMENTS

| | | | | | |
|---|---|---|---|---|---|
| 459,892 | A | * | 9/1891 | Weir | 110/241 |
| 568,393 | A | * | 9/1896 | Wilson | 126/59 |
| 643,593 | A | * | 2/1900 | Cox | 110/241 |
| 920,312 | A | | 5/1909 | Fox | |
| 1,536,220 | A | | 5/1925 | Jouclard | |
| 2,535,206 | A | | 12/1950 | Hathaway | |
| 3,259,084 | A | | 7/1966 | Hance | |
| 3,499,399 | A | * | 3/1970 | Kaufmann | 126/25 B |
| 5,134,990 | A | * | 8/1992 | Bradfield | 126/25 B |
| 5,347,935 | A | * | 9/1994 | Whitaker | 110/240 |
| 5,596,980 | A | | 1/1997 | Whalen et al. | |
| 5,915,371 | A | * | 6/1999 | Hering | 126/9 R |

* cited by examiner

*Primary Examiner*—Kenneth Rinehart
(74) *Attorney, Agent, or Firm*—Michael Best & Friedrich LLP

(57) ABSTRACT

A container for burning refuse including yard waste, household waste and the like. The container has a cylindrical portion that defines a burning chamber. The cylindrical portion includes a plurality of ventilation apertures and inwardly protruding flanges. The container also includes a cover supportable by the cylindrical portion to open and close the burning chamber. A pair of cross braces extends across a lower portion of the burning chamber to partially support the burnable refuse. During burning of the refuse, the flanges prevent the refuse from collecting along the inner walls of the burning chamber and define air flow passageways to improve air circulation through the chamber.

22 Claims, 5 Drawing Sheets

REFUSE BURNING CONTAINER

This application claims benefit of Provisional Application Ser. No. 60/326,803 filed Oct. 3, 2002.

FIELD OF THE INVENTION

The invention relates to a container for burning refuse material such as yard waste, paper products, and other flammable refuse.

BACKGROUND OF THE INVENTION

Burning refuse has long been an efficient method for reducing large amounts of debris into comparatively small piles of soot and ash. Burning refuse in this manner reduces the amount of material placed into landfills and offers certain environmental advantages associated with the reduction of waste volume. In order to prevent the fire associated with burning the refuse from spreading uncontrollably, it has long been known to place the items to be burned into a container such as a drum or barrel, thereby containing the fire within a small, easily controlled area. Oftentimes holes or other apertures are formed in the barrel to increase airflow through the barrel, thereby improving the barrel's burning characteristics.

SUMMARY OF THE INVENTION

The present invention provides a refuse burning container including a plurality of chamber walls cooperating to define a burning chamber and a central axis. Each chamber wall also defines a plurality of chamber apertures. A plurality of flanges extend radially from the chamber walls and substantially parallel to the central axis. A plurality of circumferentially extending lips extend from ends of respective flanges, and each lip is radially spaced apart from an associated chamber wall. The lips cooperate with the chamber walls to at least partially define an air flow passageway. A base is securable to the chamber walls and is engagable with the ground to support the container.

The present invention also provides a method for making a refuse burning container. The method includes forming a plurality of chamber panels having a top edge, a bottom edge, a free edge, a flange edge, and a flange extending from the flange edge, each chamber panel also defines a plurality of apertures. The free edge of a first chamber panel are coupled to the flange edge of a second chamber panel, and additional chamber panels are coupled to the first and second panels to define a burning chamber having a central axis. A cover defining a plurality of apertures is positioned on the top edges of the panels to overlie the chamber.

Other features of the invention will become apparent to those skilled in the art upon review of the following detailed description, and drawings.

Figure 1:
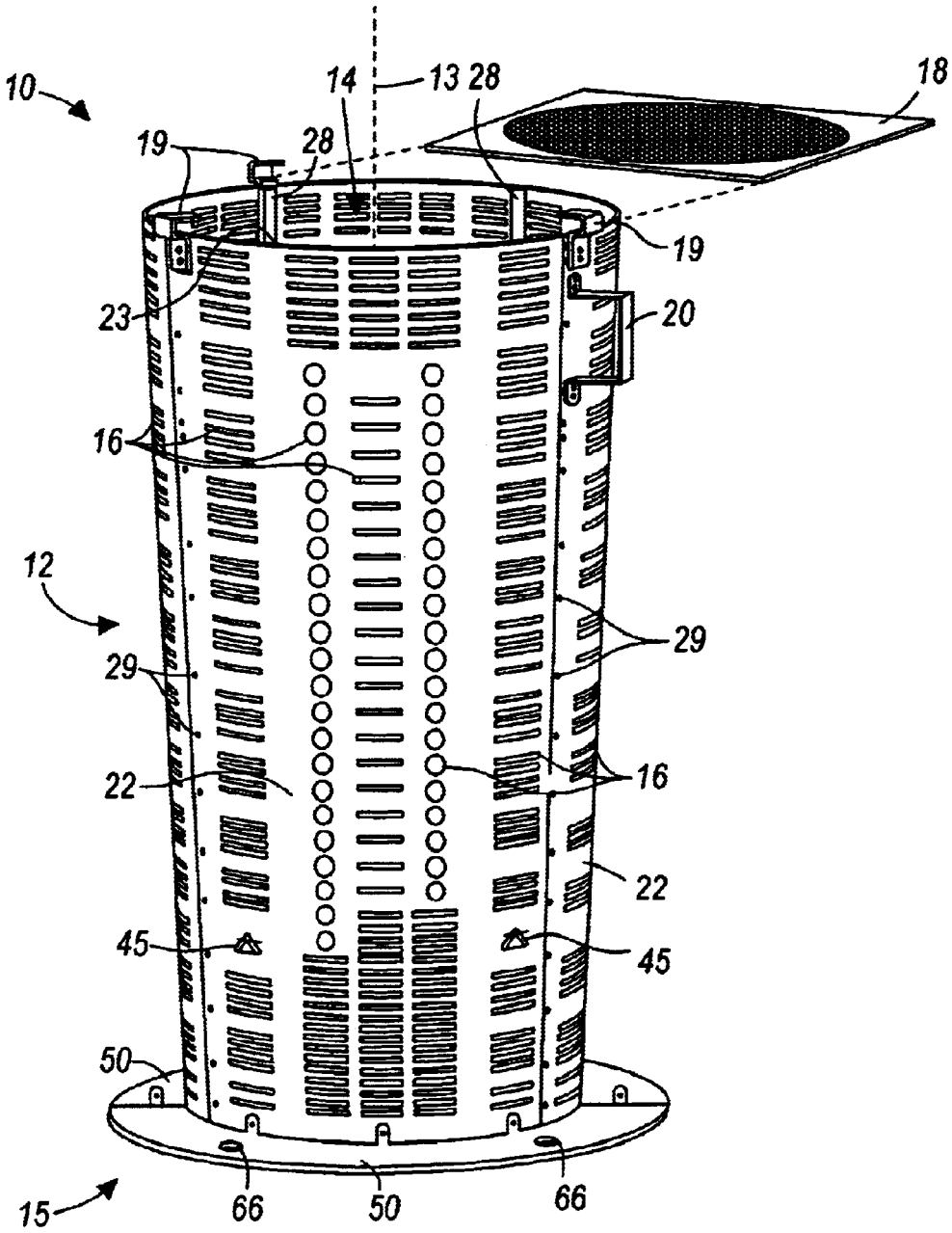
FIG. 1 is a perspective view of a refuse burning container embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

FIGS. 1–9 illustrate a refuse burning container 10 embodying the invention and which is adapted for use to burn of yard waste, burnable refuse, and the like. Referring to FIG. 1, the container 10 includes a cylindrical portion 12 having a central axis 13, and a burning chamber 14. The cylindrical portion 12 is supported by a generally annular base assembly 15 that is fixed to the cylindrical portion 12. The cylindrical portion 12 also includes a plurality of apertures 16 that afford ventilation along substantially the entire length of the cylindrical portion 12. The container 10 also includes a cover 18, cover hooks 19, and handles 20.

Figure 4:
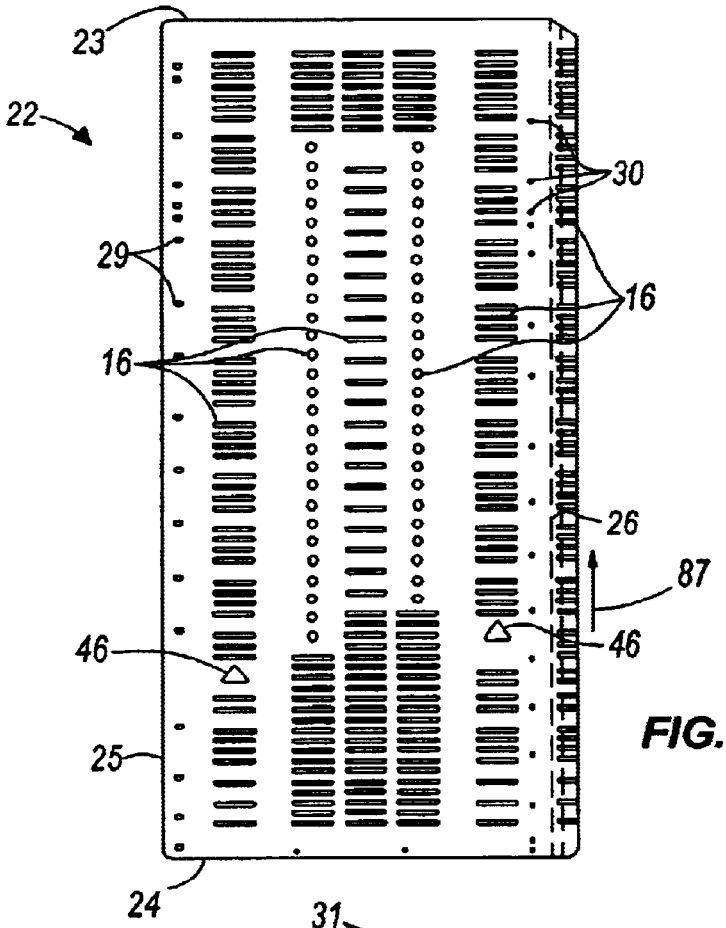
FIG. 4 is a side view of a portion of the refuse burning container illustrated in FIG. 1
Figure 2:
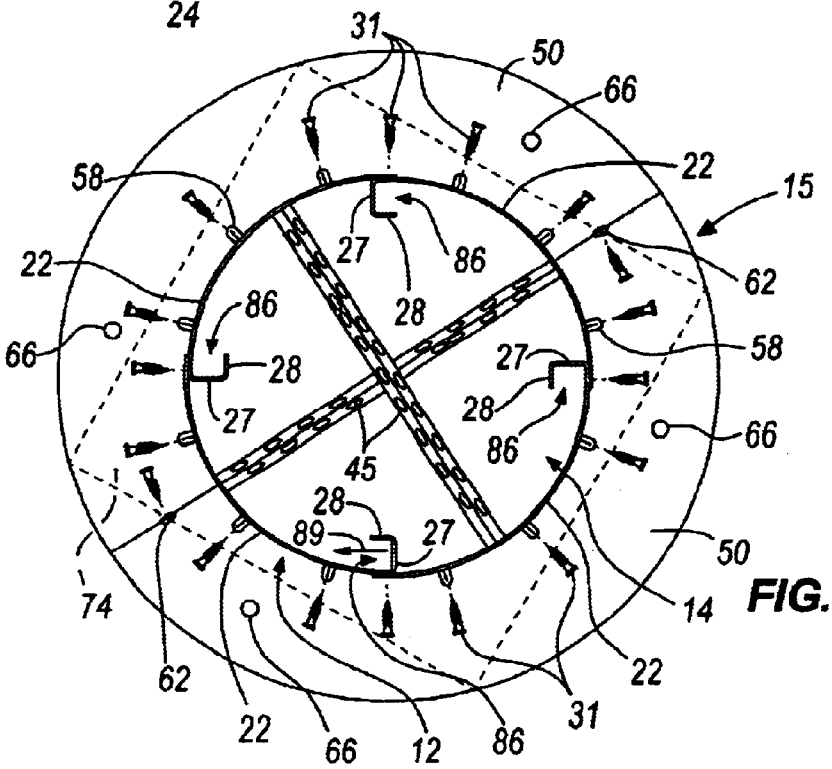
FIG. 2 is a section view taken along line 2—2 of FIG. 1.
Figure 3:
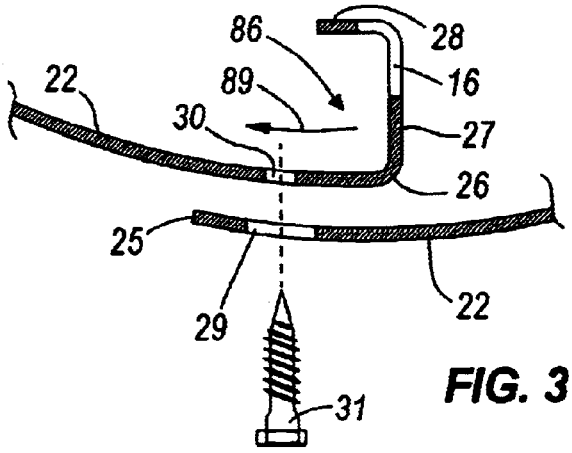
FIG. 3 is an enlarged exploded view of a portion of FIG. 2.

Referring now also to FIGS. 2–4, the cylindrical portion 12 includes a plurality (e.g. four as illustrated) of generally arcuate chamber panels 22 having formed therein the ventilation apertures 16. Each panel 22 is similarly configured and includes a top edge 23, a bottom edge 24, a free edge 25, and a flange edge 26. A flange 27 extends from the flange edge 26 of each panel 22, and a lip 28 extends from the end of each flange 27. A plurality of mounting slots 29 extend along the free edge 25 of each panel 22, and a plurality of corresponding mounting holes 30 extend along the flange edge 26 of each panel 22. The slots 29 and holes 30 are configured such that the panels 22 may be secured to each other by extending fasteners 31 through the mounting slots 29 of one panel 22 and into corresponding mounting holes 30 of an adjacent panel 22. For ease of assembly, the fasteners 31 are preferably of the self-tapping type, however other types of fasteners and other fastening methods are possible as well. Additional panels 22 are secured to one another in the manner described above until the plurality of panels 22 form a complete cylinder. Once assembled, the flanges 27 of each panel 22 extend generally radially inwardly toward the central axis 13, and the lips 28 of each panel extend generally circumferentially with respect to the cylindrical portion 12.

Those of ordinary skill in the art will readily understand that the flanges 27 and the lips 28 can be formed integrally with the panel 22. As illustrated in FIG. 4, the panel 22, the ventilation apertures 16, the mounting slots 29 and the mounting holes 30 are cut from a relatively flat sheet of material, such as a sheet of stainless steel. The flat sheet can then be bent as required to form the flanges 27 and the lips 28. In the illustrated embodiment, the bends that form the flanges 27 and the lips 28 are in the same direction. However, other methods for forming the panels 22, including bending the flat sheet in different directions, or attaching the flanges 27 and lips 28 separately, can also be successfully used. In the illustrated embodiment, the flanges 27 and the lips 28, like the rest of the panel 22, have ventilation apertures 16 formed therein.

Figure 7:
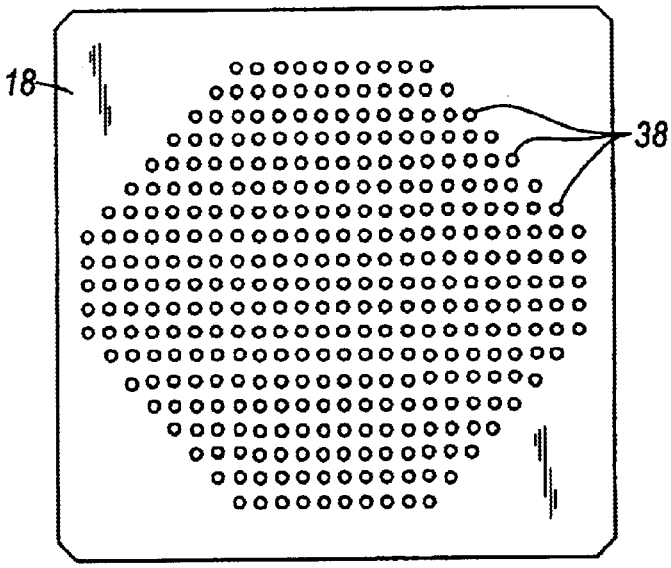
FIG. 7 is a top view of a cover for the refuse burning container illustrated in FIG. 1.
Figure 5:
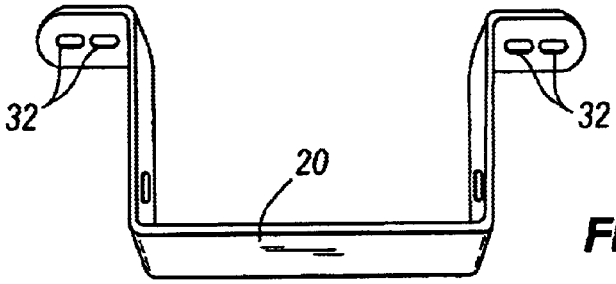
FIG. 5 is a perspective view of a handle for the refuse burning container illustrated in FIG. 1.
Figure 6:
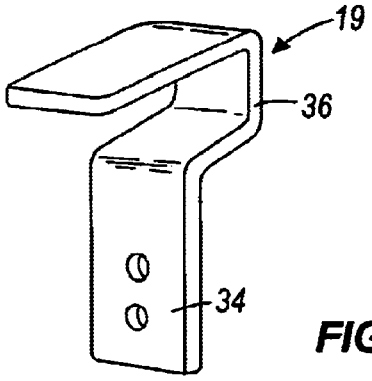
FIG. 6 is a perspective view of a cover hook for the refuse burning container illustrated in FIG. 1.

Referring also to FIGS. 5–7, the handles 20 are secured to the cylindrical portion 12 by extending fasteners (e.g. the self-tapping fasteners 31 described above) through apertures 32 in the handles 20 and through the mounting slots 29 and mounting holes 30 of the panels 22. The cover hooks 19 are secured to the cylindrical portion 12 in a similar manner, and preferably three cover hooks 19 are installed and are angularly spaced from one another by approximately 90 degrees. Each cover hook 19 includes a straight portion 34 that is secured to the panels 22, and a U-shaped portion 36 that extends over the top edges 23 of the panels 22. The cover 18 is sized to overlap the top edges 23 of the assembled cylindrical portion 12 and is received by the U-shaped portions 36 of the cover hooks 19. The cover 18 includes a plurality of holes 38 providing ventilation to the burning chamber 14 while preventing large pieces of ash or burning debris from leaving the chamber 14. The cover 18 can be slid into and out of place between the top edges 23 of the panels 22 and the U-shaped portions 36 of the cover hooks 19.

Figure 8:
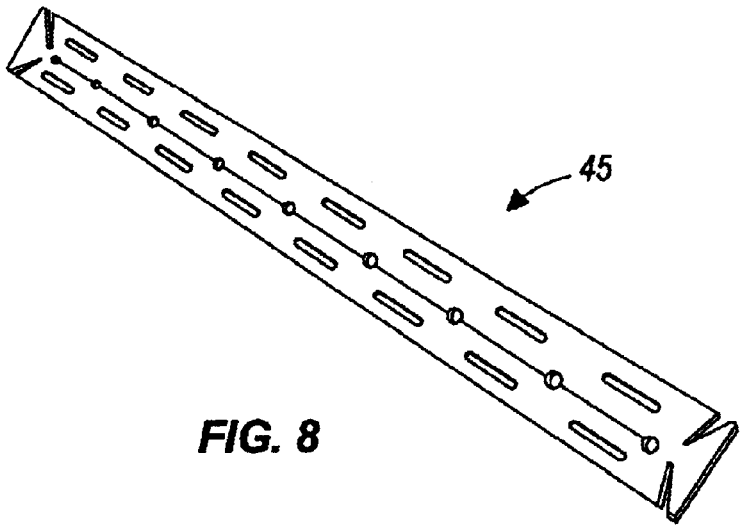
FIG. 8 is a perspective view of a cross bar for the refuse burning container illustrated in FIG. 1.
Figure 10:
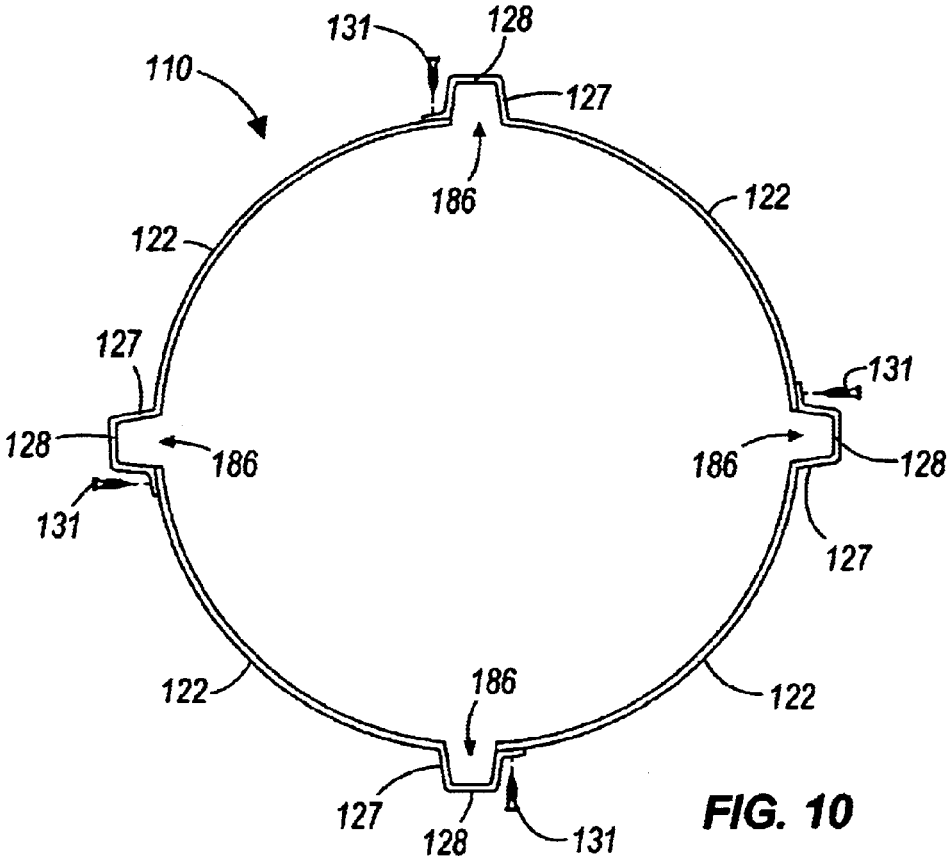
FIG. 10 is a section view similar to FIG. 3 illustrating a container which is an alternative embodiment of the invention.

Referring to FIGS. 2 and 8, pair of cross bars 45 each have a generally V-shaped cross-section and are configured to at least partially support material inserted into the burning chamber 14. The cross bars 45 are inserted into generally triangular support apertures 46 formed in the panels 22. Each cross bar 45 extends generally diametrically across the cylindrical portion 12 and is supported on each end by one of the panels 22. Preferably, the cross bars 45 are inserted such that the V-shaped cross-section points generally upwardly and such that the cross bars 45 are at an angle of approximately 90 degrees to each other when viewed along the central axis 13.

Figure 9:
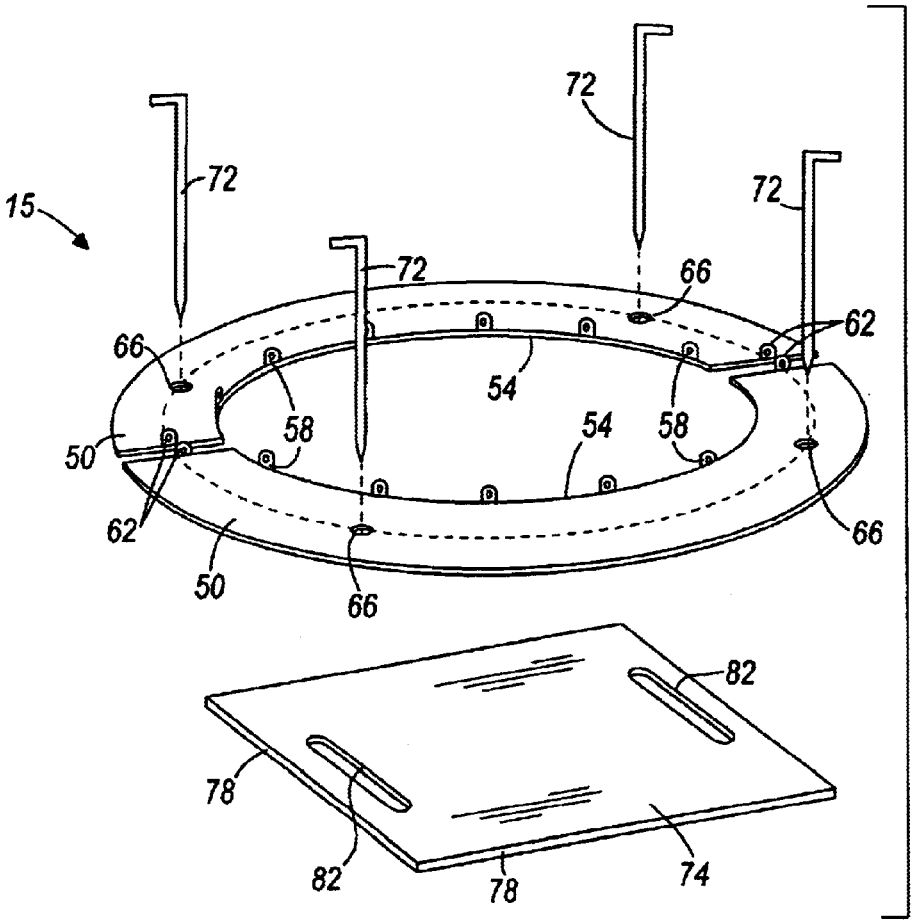
FIG. 9 is an exploded view of a base assembly for the refuse burning container illustrated in FIG. 1.

Referring to FIG. 9, the base assembly 15 includes a pair of generally semi-circular portions 50 that are preferably formed from a relatively flat sheet of metal. The semi-circular portions 50 include an inner edge 54 along which is formed a plurality of radially inwardly extending mounting tabs 58. In some embodiments, the mounting tabs 58 are formed integrally with the semi-circular portions and are bent generally upwardly to receive the cylindrical portion 12. As illustrated, the mounting tabs 58 can engage the outside surfaces of the panels 22 and are secured thereto using fasteners, such as the self-tapping fasteners 31 described above. The semi-circular portions 50 also include a pair of coupling tabs 62. The coupling tabs 62 are provided such that two semi-circular portions 50 can be secured to one another to define a generally annular support ring. When the container 10 is fully assembled, the bottom edges 24 of the panels 22 rest upon the semi-circular portions 50 between the inner edges 54 and the mounting tabs 58. The semi-circular portions 50 also include grounding apertures 66 that are spaced along a bolt circle 70. The grounding apertures receive stakes 72 that are insertable into the ground to secure the base assembly 15 and the cylindrical portion 12.

The base assembly 15 can also include a base plate 74. The illustrated base plate 74 is generally rectangular and includes sides 78 having a length that is longer than the diameter of the inner edge 54, but smaller than the diameter of the bolt circle 70. In this way, the plate substantially completely overlies the bottom portion of the burning chamber 14, but does not extend so far as to prevent the insertion of stakes 72 through the grounding apertures 66. The base plate 74 also includes a pair of slots 82 that define handles. The base plate 74 affords easy collection and disposal of burnt refuse, as discussed further below.

The container 10 can be assembled from the various components by coupling the free edge 25 of a first panel 22 to the flange edge 26 of a second panel 22. Additional panels 22 (e.g. four panels as illustrated) are then coupled to the first and second panels 22 in a similar manner until a complete cylinder is formed, thereby defining cylindrical portion 12, the burning chamber 14 and the central axis 13. As the panels 22 are coupled together, the flanges 27 can be positioned to extend radially inwardly with respect to the central axis 13. The handles 20 and the cover hooks 19 can be attached to the panels 22 using the mounting slots 29 and mounting holes 30 of the panels, although other apertures for securing the handles 20 and cover hooks 19 can be provided as well. The assembled cylindrical portion 12 is then secured to the base assembly 15. The cross bars 45 are inserted through the support apertures 46 and the cover 18 can then be positioned on the top edges 23 to overlie the burning chamber 14.

In operation, the container 10 is preferably positioned on relatively soft ground such as sand or dirt. The stakes 72 can be inserted into the ground to secure the base assembly 15 and the cylindrical portion against undesired movement or overturning. Burnable refuse, such as paper, wood, yard refuse and the like can be positioned inside the burning chamber 14. The refuse is supported at least partially by the cross bars 45, and may also rest on the base plate 74 or the ground. The refuse is supported along the sides of the burning chamber 14 at least partially by the inwardly extending flanges 27 and the circumferentially extending lips 28. The flanges 27 and the lips 28 cooperate to provide a chimney like air flow passageway 86 that keeps refuse away from the panels 22 in the area of the flanges 27 and that allows fresh air to flow along the sides of the burning chamber 14, in the direction shown by arrow 87 in FIG. 4. As can be seen in FIG. 2, the panels 22 define a first outer diameter, and the lips 28 define a second inner diameter, and the air flow passageways 86 are defined between the first and second diameters. Further, ventilation apertures formed in the flanges 27 and the lips 28 that define the air flow passageways 86 afford air flow into the burning chamber 14 transverse to the central axis 13, as shown by arrow 89 in FIGS. 2 and 3. The flanges 27 also assist in preventing refuse from overlying the ventilation apertures 16 to farther improve air flow through the burning chamber 14. The specific size and configuration of the flanges 27 and the lips 28 can be modified to achieve certain desired burning characteristics.

Preferably, the cover 18 is positioned over the refuse and the waste is lit through any of the ventilation apertures 16. Alternatively, The waste may be lit from the top, followed by positioning of the cover 18 between the U-shaped portions 36 of the cover hooks 19. As the refuse burns, fresh air is drawn into the burning chamber 14 through the ventilation apertures 16, and air flows generally upwardly through the air flow passageways 86 defined by the flanges 27 and lips 28, exiting through the holes 38 in the cover 18. The sizing and positioning of the ventilation apertures 16 and the cover holes 38 are such that large pieces of ash and/or debris are substantially prevented from leaving the burning chamber 13, while a substantial amount of air flow is maintained through the burning chamber 13. When the refuse has completely burnt and the container 10 has cooled, the stakes can be removed from the base assembly 15 and the cylindrical portion 12 and semi-circular base portions 50 can be lifted or rolled away from the base plate 74, leaving a pile of burnt refuse on the base plate 74. The base plate handle apertures can then be used to carry the base plate and the pile of burnt refuse to an appropriate refuse container where the burnt refuse can be disposed of.

FIG. 11 illustrates an alternative embodiment of the container 110. Features and components of the container 110 that are the same or similar to features and components of the container 10 have been given like reference numerals, increased by one-hundred. The container 110 is similar to the container 10, however the flanges 127 of the panels 122 extend radially outwardly, as opposed to radially inwardly. The lips 128 extend circumferentially from the ends of the flanges 127 and are coupled to an adjacent panel 122. The air flow passageways 186 of the container 110 extend along the burning chamber 113 in a similar manner as the passageways 86, but are positioned radially outwardly with respect to the panels 122. Other orientations and configurations of the panels, flanges, lips, and passageways are possible as well.

Various features of the invention are set forth in the following claims.

What is claimed is:

1. A refuse burning container comprising:

a plurality of interconnected chamber walls defining a burning chamber and a central axis, each chamber wall also defining a plurality of chamber apertures;

a plurality of flanges extending radially from the chamber walls and substantially parallel to the central axis;

a plurality of circumferentially extending lips, each of the plurality of lips extending from a respective flange, each lip being radially spaced apart from an associated chamber wall and defining therebetween an air flow passageway portion communicating with the burning chamber and affording air flow into the burning chamber; and ventilation apertures defined in at least one of the plurality of lips and the plurality of flanges, the ventilation apertures providing communication between the air flow passageways and burning chamber.

2. The refuse burning container of claim 1 and further including a cover removably supported by the chamber walls and defining a plurality of cover apertures.

3. The refuse burning container of claim 1, wherein the container is generally cylindrical and the chamber walls are substantially identical to each other.

4. The refuse burning container of claim 1, wherein each chamber wall includes a free edge and a flange edge, and each flange extends from a respective flange edge, and wherein the free edge of one chamber wall is securable to the flange edge of an adjacent chamber wall.

5. The refuse burning container of claim 4, wherein each chamber wall defines a plurality of mounting slots along the free edge, and a plurality of mounting holes along the flange edge, and wherein the chamber walls are secured to each other by extending fasteners through the mounting slots of one chamber wall, and into the mounting holes of an adjacent chamber wall.

6. The refuse burning container of claim 1, wherein the flanges extend radially inwardly toward the central axis.

7. The refuse burning container of claim 1, wherein the chamber walls define a first chamber diameter, and the lips define a second chamber diameter, and wherein the air flow passageways extend between opposite ends of the container between the first and second diameters.

8. The refuse burning container of claim 1, further comprising support bars extending across the chamber, wherein the chamber walls define support apertures and the support bars extend through the support apertures and are supported by the chamber walls.

9. The refuse burning container of claim 1, wherein the chamber walls define top edges and bottom edges, and wherein the flanges extend generally parallel to the central axis from the bottom edges to the top edges of the chamber walls.

10. The refuse burning container of claim 1, wherein the air flow passageways afford air flow into the burning chamber in a direction transverse to the central axis.

11. The refuse burning container of claim 1, wherein the air flow passageways open circumferentially into the burning chamber.

12. A refuse burning container comprising:

a plurality of panels interconnected to define a burning chamber and a central axis, each panel defining a plurality of ventilation apertures and having a top edge and a bottom edge;

a plurality of flanges formed integrally with the panels and extending radially with respect thereto from the bottom edge to the top edge;

a plurality of lips formed integrally with the panels, each lip extending generally circumferentially from a respective flange; and a plurality of ventilation apertures formed in at least one of the plurality of flanges and the plurality of lips, the panels, the flanges, and the lips cooperating to define angularly spaced apart air flow passageways that extend axially through the chamber.

13. The refuse burning container of claim 12, wherein the flanges extend radially inwardly toward the central axis.

14. The refuse burning container of claim 12, further comprising a cover supportable by the top edges of the panels and extending radially beyond the panels, the cover defining a plurality of apertures that allow fumes to pass therethrough, while substantially preventing the escape of debris from the chamber.

15. The refuse burning container of claim 12, further comprising a support plate removably securable to the bottom edges of the panels for support of the container.

16. The refuse burning container of claim 12, further comprising at least two support bars extending through at least two of the apertures and across the chamber.

17. The refuse burning container of claim 12, wherein the ventilation apertures provide communication between the air flow passageways and the burning chamber.

18. A method for assembling a refuse burning container comprising:

forming a plurality of chamber panels, each being similarly formed to include a top edge, a bottom edge, a free edge, a flange edge, and a flange extending from the flange edge, each chamber panel defining a plurality of apertures;

coupling the free edge of a first chamber panel to the flange edge of a second chamber panel;

coupling additional chamber panels to the first and second panels as needed to define a burning chamber having a central axis;

providing a generally annular support ring that is securable to the ground;

coupling the bottom edges to the support ring; and positioning a cover defining a plurality of apertures on the top edges of the panels to overlie the chamber.

19. The method of claim 18, wherein the step of coupling includes positioning the chamber panels such that the flanges extend radially inwardly with respect to the central axis.

20. The method of claim 18, wherein forming the chamber panels further includes forming the panels to include an arcuate cross section, and forming a lip extending from an end of each flange, wherein the burning chamber is generally cylindrical and the lip extends generally circumferentially with respect to the chamber and cooperates with the respective flange and panel to define an air flow passageway.

21. The method of claim 18, further comprising inserting cross braces through some of the apertures to extend across the chamber.

22. A refuse burning container comprising:

a plurality of interconnected chamber walls defining a burning chamber and a central axis, each chamber wall also defining a plurality of chamber apertures;

a plurality of flanges extending radially from the chamber walls and substantially parallel to the central axis; and a plurality of circumferentially extending lips, each of the plurality of lips extending from a respective flange, each lip being radially spaced apart from an associated chamber wall and defining therebetween an air flow passageway;

wherein each chamber wall includes a free edge and a flange edge, and each flange extends from a respective flange edge, wherein the free edge of one chamber wall is securable to the flange edge of an adjacent chamber wall, wherein each chamber wall defines a plurality of mounting slots along the free edge, and a plurality of mounting holes along the flange edge, and wherein the chamber walls are secured to each other by extending fasteners through the mounting slots of one chamber wall, and into the mounting holes of an adjacent chamber wall.

* * * * *